US010856702B2

(12) United States Patent
Droessler

(10) Patent No.: US 10,856,702 B2
(45) Date of Patent: Dec. 8, 2020

(54) SYSTEMS AND METHODS FOR A SHOWER BASE ASSEMBLY COMPATIBLE WITH RESIDENTIAL AND COMMERCIAL CONSTRUCTION

(71) Applicant: Adam Michael Droessler, Darlington, WI (US)

(72) Inventor: Adam Michael Droessler, Darlington, WI (US)

(73) Assignee: KurbX LLC, Black River Falls, WI (US)

( * ) Notice: Subject to any disclaimer, the term of this patent is extended or adjusted under 35 U.S.C. 154(b) by 0 days.

(21) Appl. No.: 16/416,035

(22) Filed: May 17, 2019

(65) Prior Publication Data

US 2019/0357734 A1 Nov. 28, 2019

Related U.S. Application Data

(60) Provisional application No. 62/676,918, filed on May 26, 2018.

(51) Int. Cl.
*A47K 3/40* (2006.01)

(52) U.S. Cl.
CPC ..... *A47K 3/405* (2013.01)

(58) Field of Classification Search
CPC ..... A47K 3/283; A47K 3/284; A47K 3/008; A47K 3/004; A47K 3/40; A47K 3/405; E03F 5/0407; E03F 5/0408; E03F 5/0409; E03C 1/20; E04F 15/02188; F16L 21/02; F16L 21/022; F16L 19/07; F16L 19/0218
See application file for complete search history.

(56) References Cited

U.S. PATENT DOCUMENTS 1,818,653 A * 8/1931 Steen ..... E03C 1/2304 4/685
2,055,173 A * 9/1936 Deubelbeiss ..... A47K 3/008 4/613

(Continued)

FOREIGN PATENT DOCUMENTS

WO WO2019231769 A1 12/2019

OTHER PUBLICATIONS

"International Search Report" and "Written Opinion of the International Searching Authority," Patent Cooperation Treaty Application No. PCT/US2019/033386, dated Jul. 25, 2019, 7 pages.

*Primary Examiner* — Patrick M. Buechner
(74) *Attorney, Agent, or Firm* — Craig A. Fieschko, Esq.; DeWitt LLP

(57) ABSTRACT

A structural, shower base assembly is provided. The assembly includes a tile-over shower base pan, a tile drain grate frame, a double threaded flange nipple, and a rubber gasket. The tile-over shower base pan includes a dorsal side pre-sloped to allow for consistent water draining to a dorsal opening of a centered drain hole of the tile-over shower base pan, and a ventral side having a ventral opening of the centered drain hole of the tile-over shower base pan and a reinforcement ring. The tile drain grate frame is compatible with the dorsal opening and the ventral opening. The double threaded flange nipple is compatible with the tile drain grate frame and an industry standard plumbing drain body. The rubber gasket is compressed to the reinforcement ring to seal a connection between the double threaded flange nipple and the industry standard plumbing drain body.

20 Claims, 6 Drawing Sheets

(56) References Cited

U.S. PATENT DOCUMENTS 2,239,969 A * 4/1941 Morthland ..... A47K 3/40 428/74
2,394,964 A * 2/1946 Dick ..... E03C 1/26 210/165
2,437,068 A * 3/1948 Birdwell ..... A47K 3/40 4/613
2,484,240 A * 10/1949 Morthland ..... A47K 3/40 4/613
2,626,674 A * 1/1953 Boosey ..... E03F 5/0408 285/14
2,705,542 A * 4/1955 Yavitch ..... E03F 5/0408 210/165
2,757,385 A * 8/1956 Whittick ..... A47K 3/405 4/613
2,780,303 A * 2/1957 Yavitch ..... E03F 5/0409 4/615
3,724,883 A * 4/1973 Dennis, Jr. ..... F16L 13/12 285/293.1
3,742,525 A * 7/1973 Oropallo ..... E03C 1/22 4/288
3,744,065 A 7/1973 Yavitch
3,937,497 A * 2/1976 Studer ..... F16L 41/14 285/111
4,067,072 A * 1/1978 Izzi ..... E03F 5/0407 285/12
4,541,132 A * 9/1985 Long ..... A47K 3/40 144/360
4,557,004 A * 12/1985 Piana ..... A47K 3/40 4/596
4,978,250 A * 12/1990 Dallmer ..... E03F 5/0407 137/362
5,022,430 A * 6/1991 Degooyer ..... E03F 5/0407 137/362
5,140,789 A * 8/1992 De Gooyer ..... A47K 3/40 4/613
5,216,767 A * 6/1993 Elmore ..... E03F 5/0408 137/362
5,745,931 A * 5/1998 Ball ..... E03C 1/20 4/286
5,913,777 A * 6/1999 Gerber ..... A47K 3/40 52/35
8,043,497 B2 * 10/2011 Silverstein ..... E03F 5/0407 210/164
8,918,926 B1 * 12/2014 Herring ..... E03F 5/0408 4/613
2007/0017578 A1 * 1/2007 Dallmer ..... E03F 5/0408 137/362
2008/0022455 A1 * 1/2008 McAlpine ..... E03F 5/0408 4/679
2008/0163420 A1 * 7/2008 Dieter ..... A47K 3/40 4/613
2008/0222794 A1 9/2008 Cook
2010/0064430 A1 * 3/2010 Goodson ..... A47K 3/40 4/613
2010/0071125 A1 * 3/2010 Miller ..... A47K 3/40 4/613
2010/0170035 A1 * 7/2010 Kik, Sr. ..... A47K 3/405 4/613
2010/0320130 A1 * 12/2010 Meyers ..... E03F 5/04 210/164
2011/0197351 A1 8/2011 Cook
2012/0272449 A1 * 11/2012 Wedi ..... E04F 15/02188 4/613
2014/0131996 A1 * 5/2014 Murphy ..... E03F 5/0409 285/136.1
2014/0157514 A1 6/2014 Cook
2019/0242107 A1 * 8/2019 McLeod ..... E03F 5/0407

* cited by examiner

SYSTEMS AND METHODS FOR A SHOWER BASE ASSEMBLY COMPATIBLE WITH RESIDENTIAL AND COMMERCIAL CONSTRUCTION

CROSS-REFERENCE TO RELATED APPLICATION

This Patent Application claims the priority and benefit of U.S. Provisional Patent Application Ser. No. 62/676,918, filed May 26, 2018, titled "Shower Base Assembly," which is hereby incorporated by reference herein in its entirety including all references cited therein.

FIELD OF INVENTION

The present technology pertains to shower installations. In particular, but not by way of limitation, the present technology provides systems and methods for a structural, tile-over shower base assembly with a centered drain compatible with a double threaded flange nipple.

SUMMARY

According to some embodiments, the present technology is directed to a structural, shower base assembly compatible with residential and commercial construction, comprising: a tile-over shower base pan capable of spanning floor joists for easy installation of a curbless tiled shower, comprising: a dorsal side of the tile-over shower base pan, the dorsal side of the tile-over shower base pan being pre-sloped to allow for consistent water draining to a dorsal opening of a centered drain hole of the tile-over shower base pan; and a ventral side of the tile-over shower base pan, the ventral side comprising a ventral opening of the centered drain hole of the tile-over shower base pan and a reinforcement ring. In various embodiments the shower base assembly further comprises a tile drain grate frame, the tile drain grate frame being compatible with the dorsal opening of the centered drain hole and the ventral opening of the centered drain hole; a double threaded flange nipple, the double threaded flange nipple being compatible with the tile drain grate frame and an industry standard plumbing drain body; and a rubber gasket, the rubber gasket being compressed by the double threaded flange nipple and the industry standard plumbing drain body to the reinforcement ring allowing a water tight seal at a connection between the double threaded flange nipple and the industry standard plumbing drain body via the compressed rubber gasket thereby decreasing installation time of the structural, shower base assembly because the dorsal side of the tile-over shower base pan does not need to be waterproofed at a connection to a drain. In various embodiments the rubber gasket further comprises a Teflon® gasket to further seal the drain-to-pan joint and to provide durability.

In various embodiments the dorsal side of the tile-over shower base pan has a textured surface, the textured surface boding with tile setting mortar. In some embodiments the textured surface has a depth, the depth being 0.004 inches or less allowing for enhanced bonding between the textured surface of the dorsal side of the tile-over shower base pan and the tile setting mortar.

In various embodiments the shower base assembly further comprises a removable grate, the removable grate being seamlessly connected with the tile drain grate frame, the removable grate seamlessly connected with the tile drain grate frame allowing for increased water flow into the industry standard plumbing drain body through a wide drain throat.

In some embodiments a diameter of the centered drain hole is less than 3.25 inches minimizing a possibility of the centered drain hole landing on an obstruction in a floor system during installation. In various embodiments a diameter of the reinforcement ring of the ventral side of the tile-over shower base pan is less than 4.5 inches minimizing a possibility of the centered drain hole landing on an obstruction in a floor system during installation.

In some embodiments a diameter of the centered drain hole is less than 3.5 inches minimizing a possibility of the centered drain hole landing on an obstruction in a floor system during installation. In various embodiments a diameter of the reinforcement ring is less than 4.5 inches minimizing a possibility of the centered drain hole landing on an obstruction in a floor system during installation.

In various embodiments the tile-over shower base pan is less than 1 inch thick allowing for the spanning floor joists for easy installation of the curbless tiled shower.

In various embodiments the tile-over shower base pan comprises glass-mat thermoplastic (GMT) allowing for the spanning floor joists for easy installation of the curbless tiled shower.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 1:
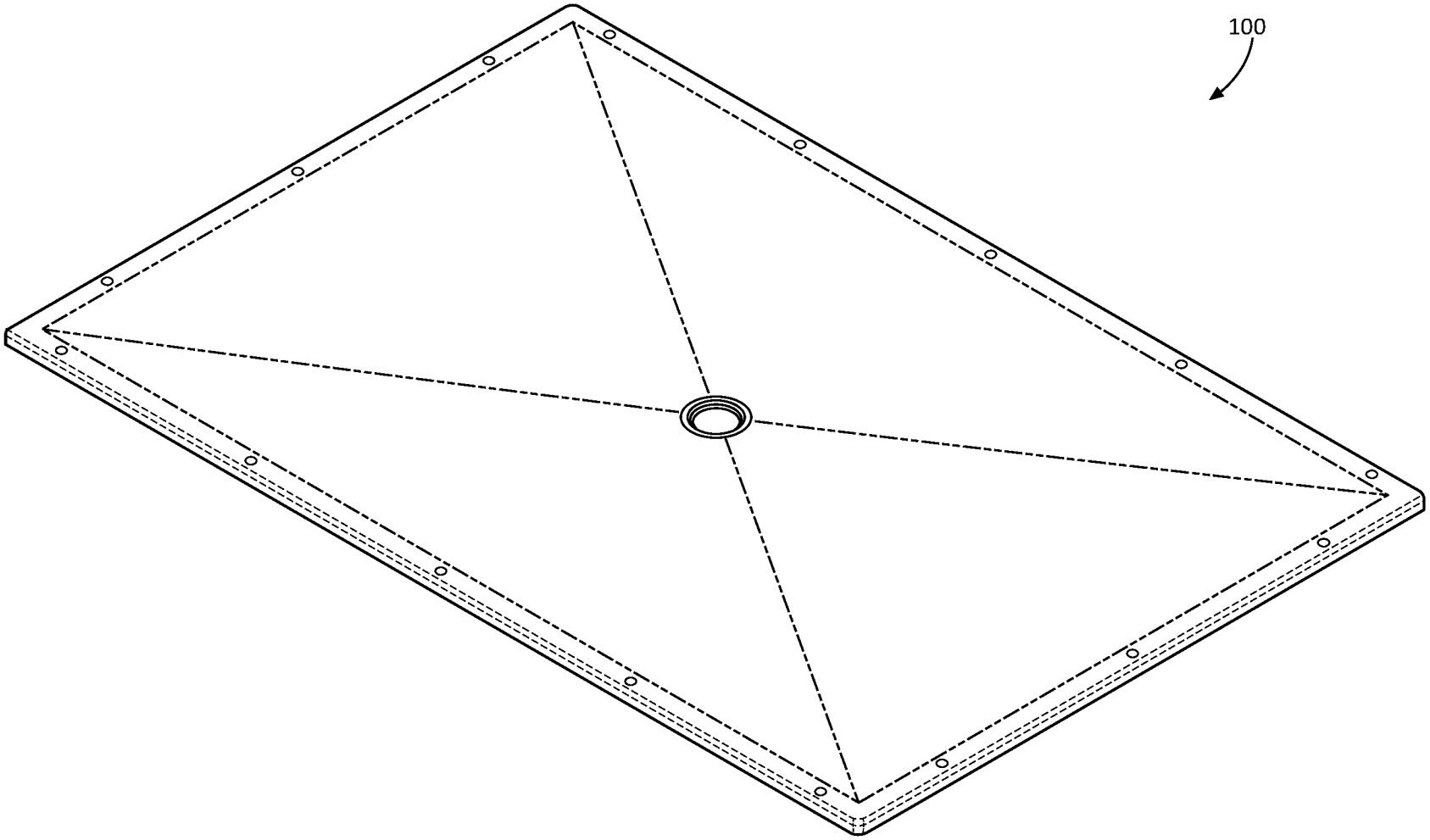
FIG. 1 illustrates a top perspective view of a structural, shower base assembly compatible with residential and commercial construction with a center drain according to various embodiments of the present technology.

While the present technology is susceptible of embodiment in many different forms, there is shown in the drawings and will herein be described in detail several specific embodiments with the understanding that the present disclosure is to be considered as an exemplification of the principles of the present technology and is not intended to limit the technology to the embodiments illustrated.

In the description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Existing structural shower tray installations do not provide a small, centered drain location and cannot be used on concrete substrates above the first floor for commercial applications. A small drain hole allows the present technology to overcome problems of existing shower tray installations that do not provide a small diameter drain assembly and a minimal depth and diameter reinforcement ring on a bottom side of a tray, thus, causing installation compatibility problems for all floor systems.

In various embodiments, the present technology provides a structural, tile-over shower base with a center drain. Various embodiments shrink the drain hole down and provide a center drain location.

In some embodiments, the drain hole is considerably smaller than prior drain holes, which allows the drain to be centered. All existing devices have a large drain hole which requires reinforcement of the perimeter of the drain hole that does not allow for a centered drain and forces the drain to be "off center" on all shower trays. Furthermore, the large drain body hole combined with a reinforcement ring make it difficult to miss installation obstructions (e.g., wooden joists, post tension cables, and the like.)

FIG. 1 illustrates a top perspective view 100 of a structural, shower base assembly compatible with residential and commercial construction with a center drain according to various embodiments of the present technology. In various embodiments, the shower base (i.e., shower pan, shower tray, shower foundation, shower receptor) is a pre-pitched shower tray consisting of structural and reinforced plastics and compound resins including, but not limited to glass reinforced plastic, fiberglass reinforced plastic, and the like. For example, the tile-over shower base pan may comprise glass-mat thermoplastic (GMT) allowing for the spanning floor joists for easy installation of the curbless tiled shower. In some instances, the shower base is 47.25 inches by 71 inches although the shower base may be cut to all sizes for customization and compatibility in various embodiments. In some embodiments, the shower tray is fastened to the substrate using fasteners which create a structural, pre-pitched shower area to be waterproofed at the edges of the pan and covered with a finished floor covering.

FIG. 1 shows a top perspective view 100 of a structural, shower base assembly compatible with residential and commercial construction with a center drain according to various embodiments of the present technology. The top perspective view 100 shows a tile-over shower base pan capable of spanning floor joists for easy installation of a curbless tiled shower, comprising: a dorsal side of the tile-over shower base pan, the dorsal side of the tile-over shower base pan being pre-sloped to allow for consistent water draining to a dorsal opening of a centered drain hole of the tile-over shower base pan.

Figure 2A:
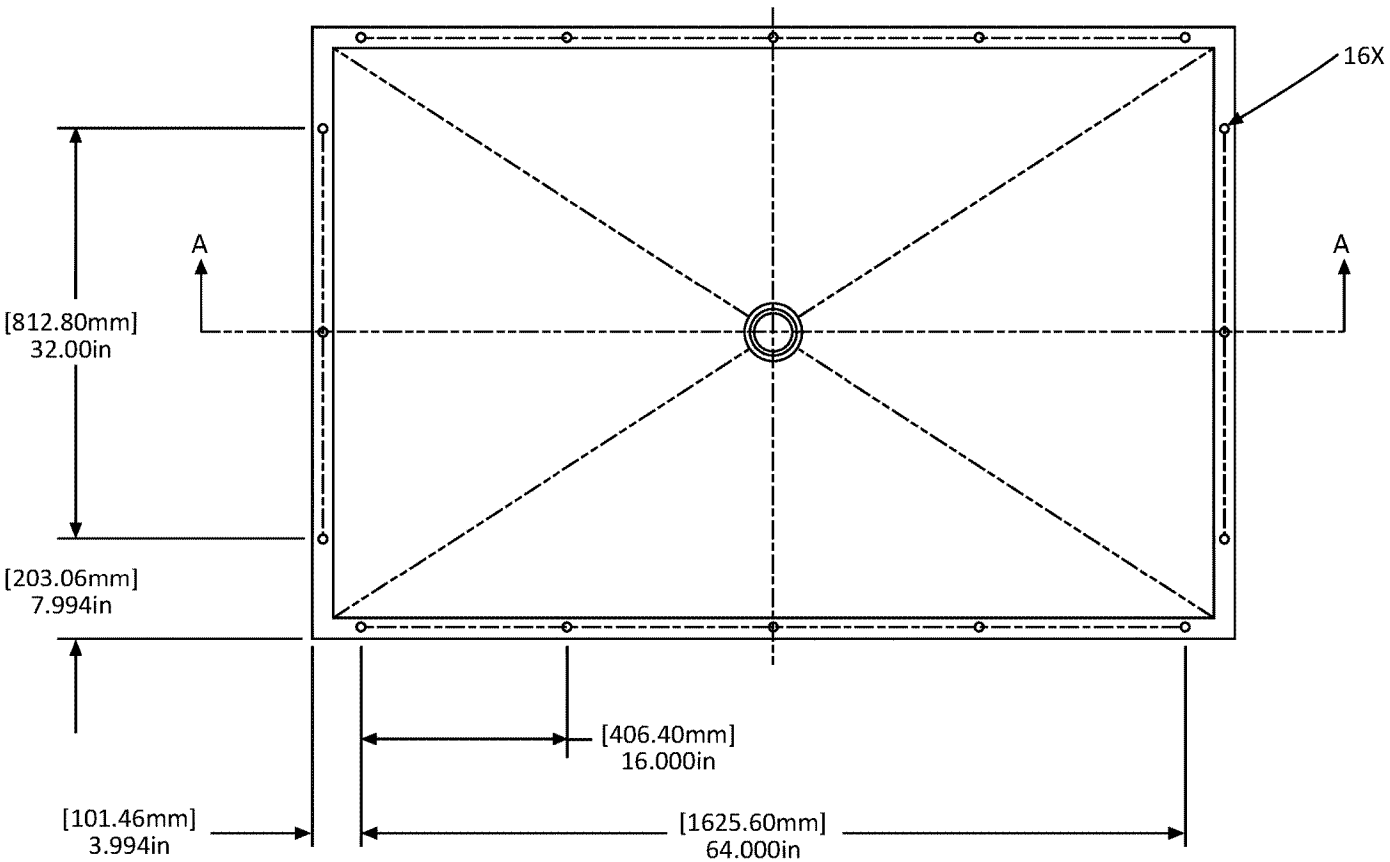
FIG. 2A illustrates a top view of a shower base with a center drain according to various embodiments of the present technology.

FIG. 2A illustrates a top view of a shower base with a center drain according to various embodiments of the present technology. FIG. 2A shows the centered drain location and dimensions of the shower tray according to various embodiments. In some instances, for example, for installation of a tub conversion to a shower, the drain is not centered for convenience of the installer with regards to existing plumbing in the floor.

Figure 2B:
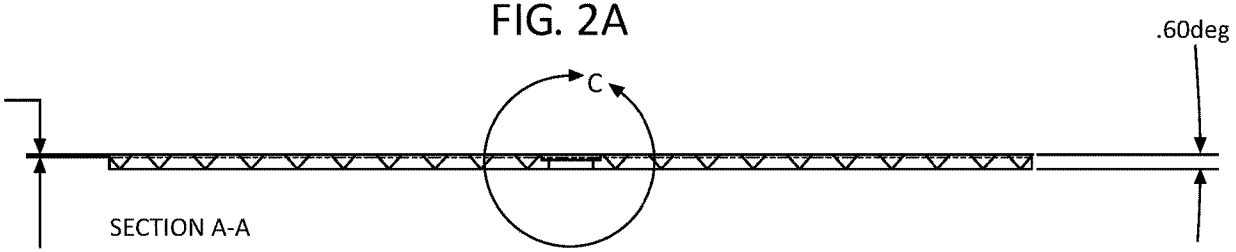
FIG. 2B illustrates a side view of a shower base with a center drain according to various embodiments of the present technology.

FIG. 2B illustrates a side view of a shower base with a center drain according to various embodiments of the present technology. FIG. 2B shows a drain hole that has been reduced to a smallest diameter possible to still meet plumbing drainage codes.

Figure 3:
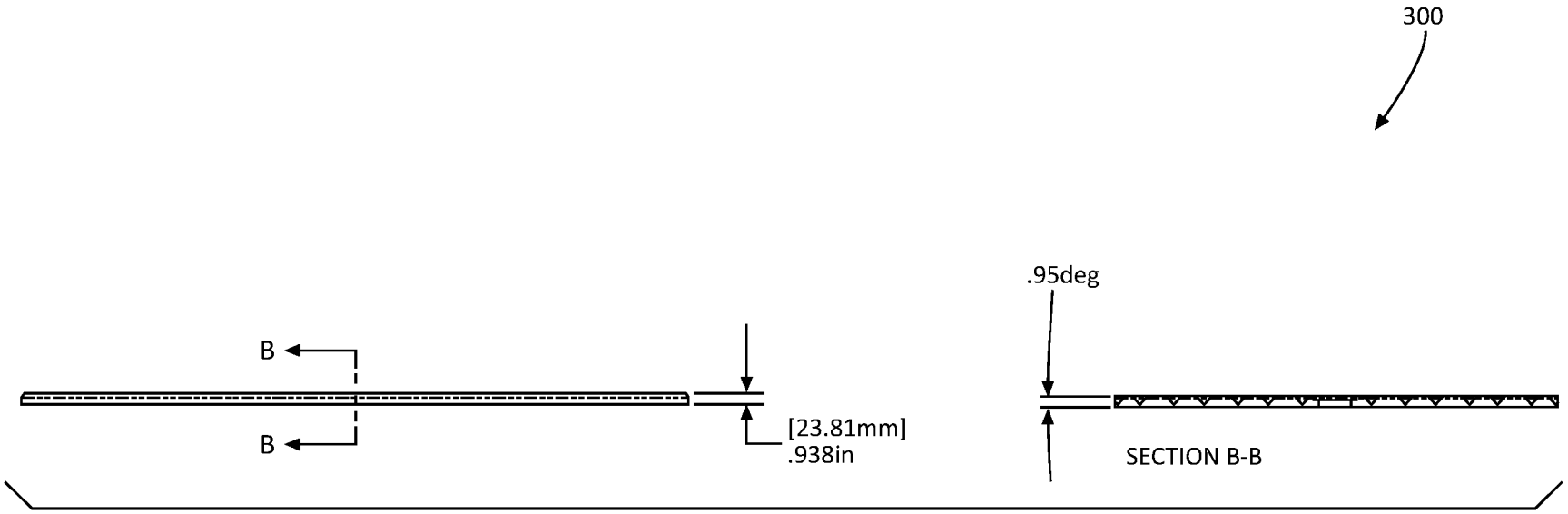
FIG. 3 illustrates another side view of a shower base with a center drain according to various embodiments of the present technology.

FIG. 3 illustrates another side view 300 of a shower base with a center drain according to various embodiments of the present technology. FIG. 3 also shows a cross section of the shower pan along line B-B and dimensions of the shower tray according to various embodiments.

Figure 4:
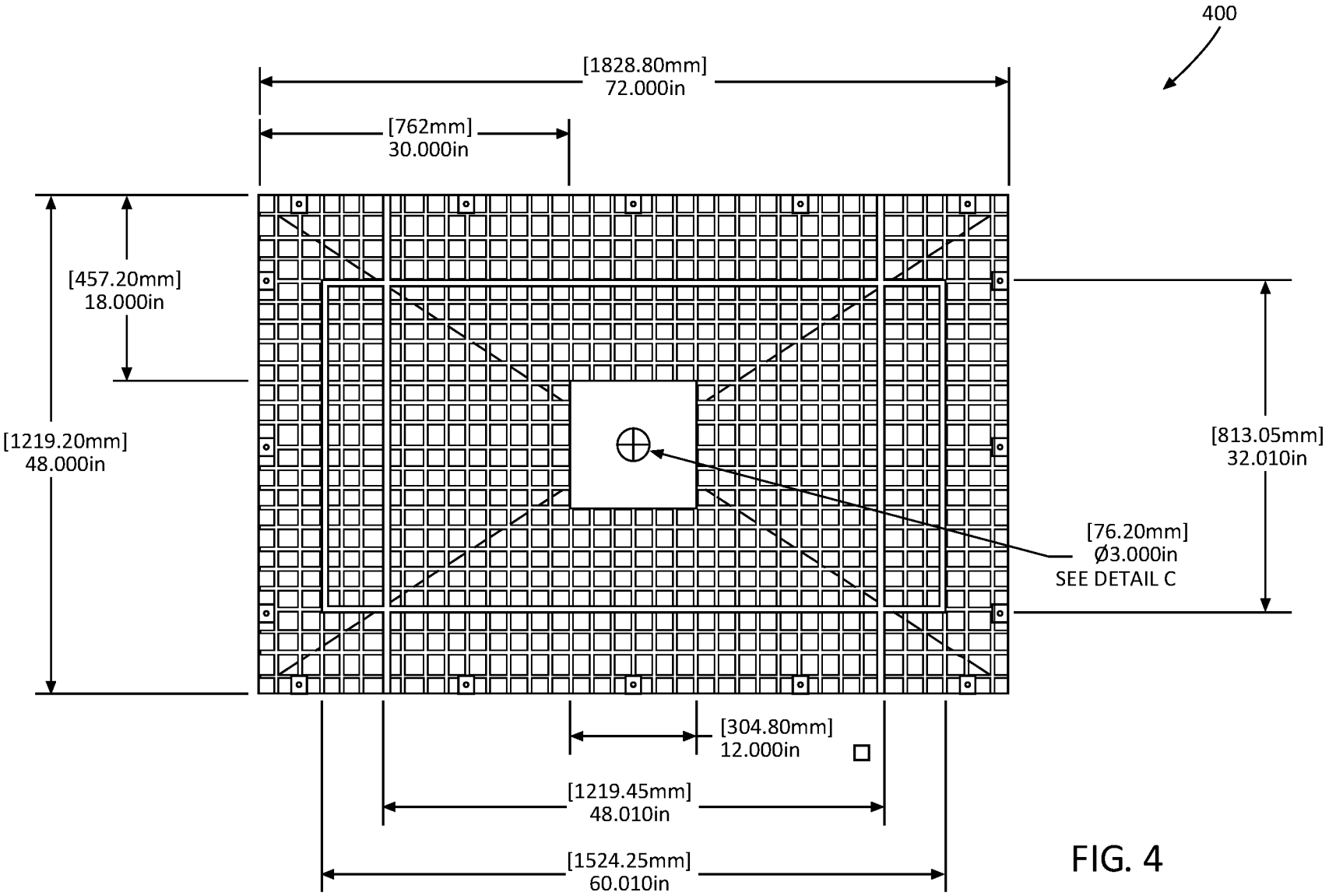
FIG. 4 illustrates bottom view of a shower base with a center drain according to various embodiments of the present technology.

FIG. 4 illustrates bottom view 400 of a shower base with a center drain and dimensions of the shower tray according to various embodiments of the present technology. Furthermore, the bottom side of the shower tray is made of "waffled" construction to reduce the material necessary to make the bottom of the shower pan and provide easy deflection when a substrate is uneven while also reducing weight of the shower tray.

FIG. 4 shows bottom view 400 of a shower base with a center drain according to various embodiments of the present technology. The bottom view 400 of a shower base with a center drain shows a tile-over shower base pan capable of spanning floor joists for easy installation of a curbless tiled shower, comprising: a ventral side of the tile-over shower base pan, the ventral side comprising a ventral opening of the centered drain hole of the tile-over shower base pan.

Figure 5B:
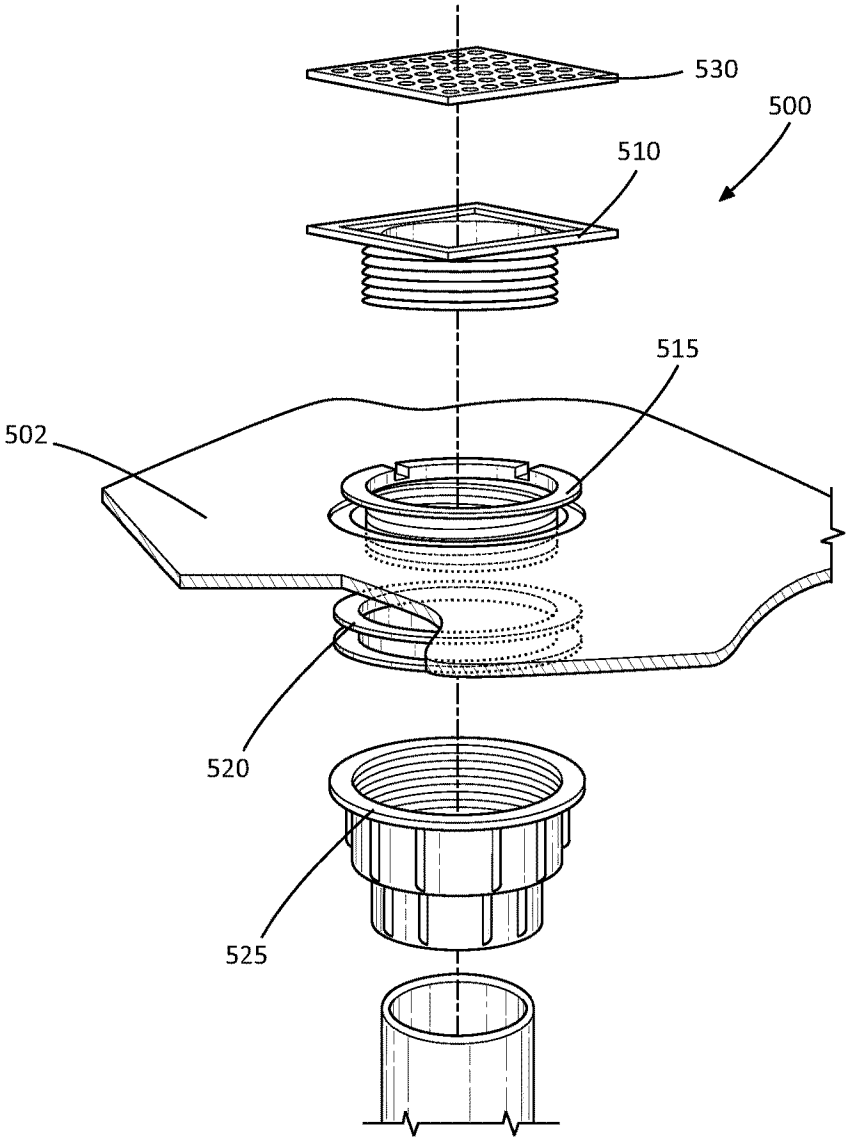
FIG. 5B illustrates a drawing of a side perspective view of drain installation of a structural, shower base assembly compatible with residential and commercial construction with a center drain according to various embodiments of the present technology.
Figure 5A:
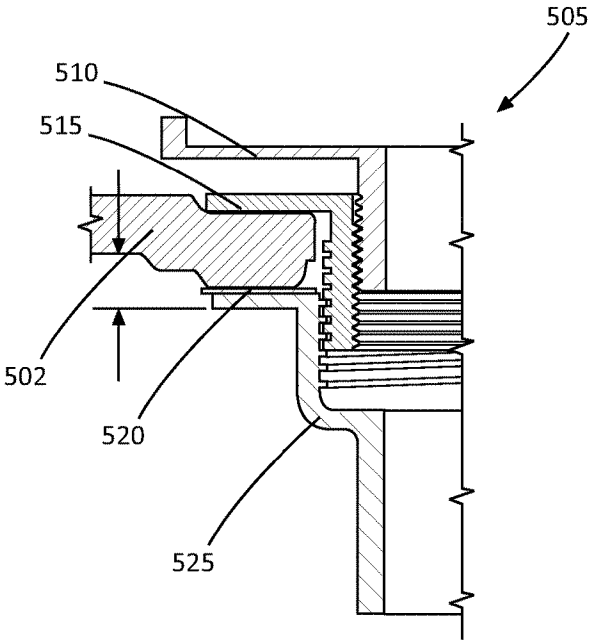
FIG. 5A illustrates a cross-section view of a structural, shower base assembly

FIG. 5A illustrates a cross-section view 505 of a structural, shower base assembly. FIG. 5B illustrates a drawing 500 of a side perspective view of drain installation of a structural, shower base assembly compatible with residential and commercial construction with a center drain according to various embodiments of the present technology.

The drawing 500 of a side perspective view of drain installation a structural, shower base assembly compatible with residential and commercial construction with a center drain according to various embodiments. The drawing 500 shows a tile drain grate frame 510, the tile drain grate frame 510 being compatible with the dorsal opening of the centered drain hole and the ventral opening of the centered drain hole; a double threaded flange nipple 515, the double threaded flange nipple being compatible with the tile drain grate frame 510 and an industry standard plumbing drain body 525; and a rubber gasket 520 that gets compressed to the reinforcement ring portion of the tile-over shower base pan 502 between the double threaded flange nipple 515 and the industry standard plumbing drain body 525 thereby compressing the rubber gasket 520 to the reinforcement ring allowing a water tight seal at a connection between the double threaded flange nipple 515 and the industry standard plumbing drain body 525 thereby decreasing installation time of the structural, shower base assembly because the dorsal side of the tile-over shower base pan 502 does not need to be waterproofed in order to seal the drain-to-pan joint. In various embodiments the rubber gasket 520 further comprises a Teflon® gasket to further seal the drain-to-pan joint and to provide durability.

According to various embodiments the drawing 500 shows the shower base assembly further comprises a removable grate 530, the removable grate 530 being seamlessly connected with the tile drain grate frame 510, the removable grate 530 seamlessly connected with the tile drain grate frame 510 allowing for increased water flow into the industry standard plumbing drain body 525 through a wide drain throat. A drain throat of the present technology is wider than an industry standard drain throat, thus, a drain throat of the present technology allows for increased water flow.

Figure 6:
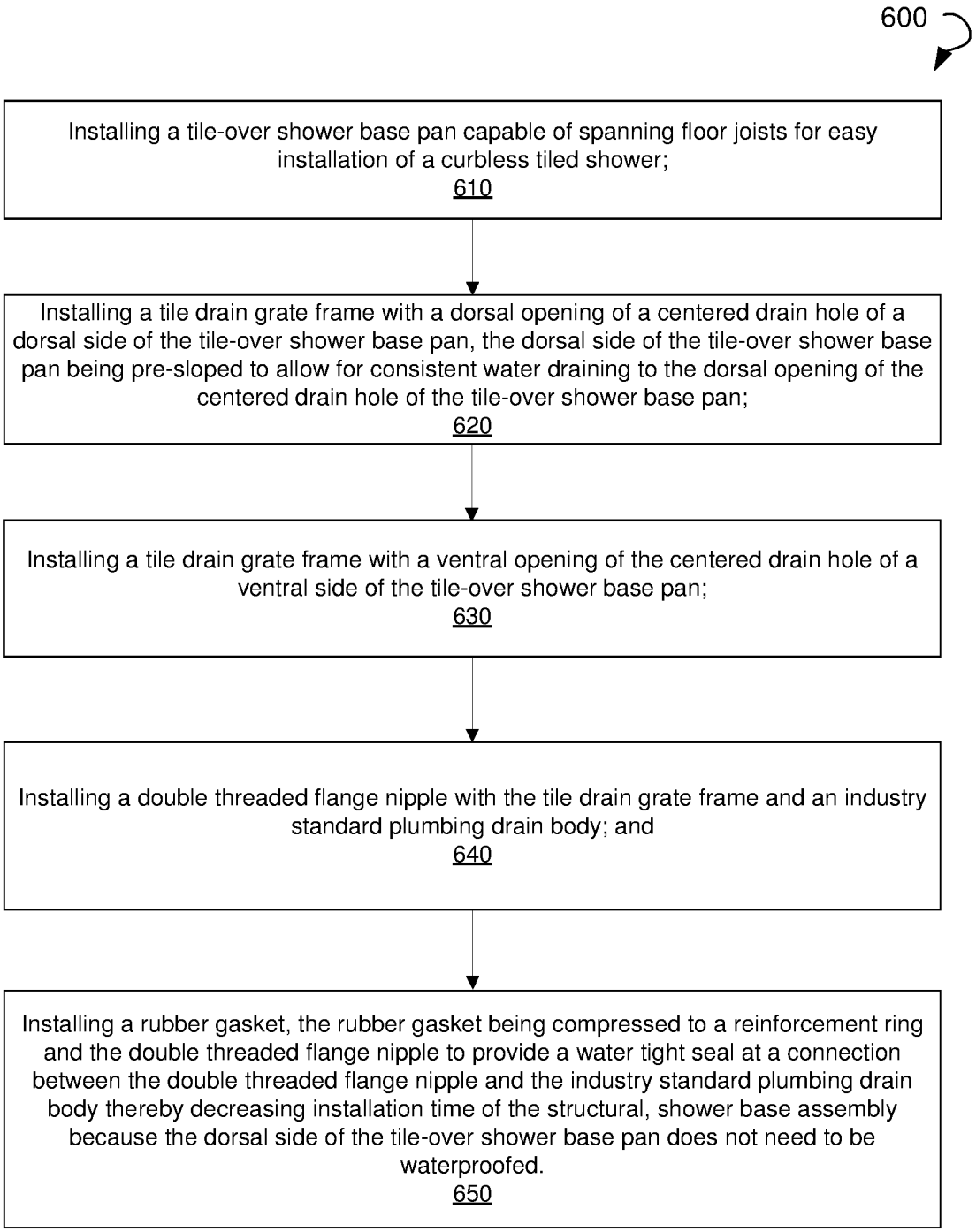
FIG. 6 is a process flow diagram showing a method for a structural, shower base assembly installation compatible with residential and commercial construction, according to one or more example embodiments of the present technology.

FIG. 6 is a process flow diagram showing a method 600 for a structural, shower base assembly installation compatible with residential and commercial construction, according to one or more example embodiments of the present technology. As shown in FIG. 6, the method 600 may commence at operation 610, with installing a tile-over shower base pan capable of spanning floor joists for easy installation of a curbless tiled shower.

At operation 620, the method 600 may proceed with installing a tile drain grate frame with a dorsal opening of a centered drain hole of a dorsal side of the tile-over shower base pan, the dorsal side of the tile-over shower base pan being pre-sloped to allow for consistent water draining to the dorsal opening of the centered drain hole of the tile-over shower base pan.

At operation 630, the method 600 may include installing a tile drain grate frame with a ventral opening of the centered drain hole of a ventral side of the tile-over shower base pan.

At operation 640, the method 600 may proceed with installing a double threaded flange nipple with the tile drain grate frame and an industry standard plumbing drain body.

At operation 650, the method 600 may include compressing a rubber gasket to a reinforcement ring by screwing the double threaded flange nipple to the industry standard plumbing drain body to provide a water tight seal at a connection between the double threaded flange nipple and the industry standard plumbing drain body thereby decreasing installation time of the structural, shower base assembly because the dorsal side of the tile-over shower base pan does not need to be waterproofed. In various embodiments the rubber gasket further comprises a Teflon® gasket to further seal the drain-to-pan joint and to provide durability. In various embodiments the dorsal side of the tile-over shower base pan has a textured surface, the textured surface boding with tile setting mortar. In some embodiments the textured surface has a depth, the depth being 0.004 inches or less allowing for enhanced bonding between the textured surface of the dorsal side of the tile-over shower base pan and the tile setting mortar.

In various embodiments the dorsal side of the tile-over shower base pan has a textured surface, the textured surface boding with tile setting mortar.

In some embodiments the textured surface has a depth, the depth being 0.004 inches or less allowing for enhanced bonding between the textured surface of the dorsal side of the tile-over shower base pan and the tile setting mortar.

In various embodiments the shower base assembly further comprises a removable grate, the removable grate being seamlessly connected with the tile drain grate frame, the removable grate seamlessly connected with the tile drain grate frame allowing for increased water flow into the industry standard plumbing drain body through a wide drain throat. A drain throat of the industry standard plumbing drain body is wider than a standard drain throat that allows for increased water flow.

In some embodiments a diameter of the centered drain hole is less than 3.25 inches minimizing a possibility of the centered drain hole landing on an obstruction in a floor system during installation. In various embodiments a diameter of the reinforcement ring of the ventral side of the tile-over shower base pan is less than 4.5 inches minimizing a possibility of the centered drain hole landing on an obstruction in a floor system during installation.

In some embodiments a diameter of the centered drain hole is less than 3.5 inches minimizing a possibility of the centered drain hole landing on an obstruction in a floor system during installation. In various embodiments a diameter of the reinforcement ring is less than 4.5 inches minimizing a possibility of the centered drain hole landing on an obstruction in a floor system during installation.

In various embodiments the tile-over shower base pan is less than 1 inch thick allowing for the spanning floor joists for easy installation of the curbless tiled shower.

In various embodiments the tile-over shower base pan comprises glass-mat thermoplastic (GMT) allowing for the spanning floor joists for easy installation of the curbless tiled shower.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel, or may be performed at different times.

While this technology is susceptible of embodiments in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A structural, shower base assembly compatible with residential and commercial construction, comprising:

a tile-over shower base pan capable of spanning floor joists for installation of a curbless tiled shower, comprising:

a dorsal side of the tile-over shower base pan, the dorsal side of the tile-over shower base pan being pre-sloped to allow for water draining to a dorsal opening of a centered drain hole of the tile-over shower base pan; and a ventral side of the tile-over shower base pan, the ventral side comprising a ventral opening of the centered drain hole of the tile-over shower base pan and a reinforcement ring;

a tile drain grate frame, the tile drain grate frame being compatible with the dorsal opening of the centered drain hole and the ventral opening of the centered drain hole;

a double threaded flange nipple, the double threaded flange nipple being compatible with the tile drain grate frame and an industry standard plumbing drain body; and a rubber gasket, the rubber gasket being compressed by the double threaded flange nipple and the industry standard plumbing drain body to the reinforcement ring allowing a water tight seal at a connection between the double threaded flange nipple and the industry standard plumbing drain body via the compressed rubber gasket thereby decreasing installation time of the structural, shower base assembly because the dorsal side of the tile-over shower base pan does not need to be waterproofed at a connection to a drain.

2. The structural, shower base assembly of claim 1, wherein the dorsal side of the tile-over shower base pan has a textured surface, the textured surface bonding with tile setting mortar.

3. The structural, shower base assembly of claim 2, wherein the textured surface has a depth, the depth being 0.004 inches or less allowing for bonding between the textured surface of the dorsal side of the tile-over shower base pan and the tile setting mortar.

4. The structural, shower base assembly of claim 1, further comprising a removable grate, the removable grate being seamlessly connected with the tile drain grate frame, the removable grate seamlessly connected with the tile drain grate frame allowing for increased water flow into the industry standard plumbing drain body through a drain throat.

5. The structural, shower base assembly of claim 1, wherein a diameter of the centered drain hole is less than 3.25 inches decreasing a possibility of the centered drain hole landing on an obstruction in a floor system during installation.

6. The structural, shower base assembly of claim 5, wherein a diameter of the reinforcement ring of the ventral side of the tile-over shower base pan is less than 4.5 inches decreasing a possibility of the centered drain hole landing on an obstruction in a floor system during installation.

7. The structural, shower base assembly of claim 1, wherein a diameter of the centered drain hole is less than 3.5 inches decreasing a possibility of the centered drain hole landing on an obstruction in a floor system during installation.

8. The structural, shower base assembly of claim 7, wherein a diameter of the reinforcement ring is less than 4.5 inches decreasing a possibility of the centered drain hole landing on an obstruction in a floor system during installation.

9. The structural, shower base assembly of claim 1, wherein the tile-over shower base pan is less than 1 inch thick allowing for the spanning floor joists for installation of the curbless tiled shower.

10. The structural, shower base assembly of claim 1, wherein the tile-over shower base pan comprises glass-mat thermoplastic (GMT) allowing for the spanning floor joists for installation of the curbless tiled shower.

11. A method for structural, shower base assembly installation compatible with residential and commercial construction, the method comprising:

installing a tile-over shower base pan capable of spanning floor joists for installation of a curbless tiled shower;

installing a tile drain grate frame with a dorsal opening of a centered drain hole of a dorsal side of the tile-over shower base pan, the dorsal side of the tile-over shower base pan being pre-sloped to allow for water draining to the dorsal opening of the centered drain hole of the tile-over shower base pan;

installing a tile drain grate frame with a ventral opening of the centered drain hole of a ventral side of the tile-over shower base pan;

installing a double threaded flange nipple with the tile drain grate frame and an industry standard plumbing drain body; and installing a rubber gasket, the rubber gasket being compressed to a reinforcement ring and the double threaded flange nipple to provide a water tight seal at a connection between the double threaded flange nipple and the industry standard plumbing drain body thereby decreasing installation time of the structural, shower base assembly because the dorsal side of the tile-over shower base pan does not need to be waterproofed.

12. The method for structural, shower base assembly of claim 11, wherein the dorsal side of the tile-over shower base pan has a textured surface, the textured surface bonding with tile setting mortar.

13. The method for structural, shower base assembly of claim 12, wherein the textured surface has a depth, the depth being 0.004 inches or less allowing for bonding between the textured surface of the dorsal side of the tile-over shower base pan and the tile setting mortar.

14. The method for structural, shower base assembly of claim 11, further comprising a removable grate, the removable grate being seamlessly connected with the tile drain grate frame, the removable grate seamlessly connected with the tile drain grate frame allowing for increased water flow into the industry standard plumbing drain body through a drain throat.

15. The method for structural, shower base assembly of claim 11, wherein a diameter of the centered drain hole is less than 3.25 inches decreasing a possibility of the centered drain hole landing on an obstruction in a floor system during installation.

16. The method for structural, shower base assembly of claim 15, wherein a diameter of the reinforcement ring of the ventral side of the tile-over shower base pan is less than 4.5 inches decreasing a possibility of the centered drain hole landing on an obstruction in a floor system during installation.

17. The method for structural, shower base assembly of claim 11, wherein a diameter of the centered drain hole is less than 3.5 inches decreasing a possibility of the centered drain hole landing on an obstruction in a floor system during installation.

18. The method for structural, shower base assembly of claim 17, wherein a diameter of the reinforcement ring is less than 4.5 inches decreasing a possibility of the centered drain hole landing on an obstruction in a floor system during installation.

19. The method for structural, shower base assembly of claim 11, wherein the tile-over shower base pan is less than 1 inch thick allowing for the spanning floor joists for installation of the curbless tiled shower.

20. The method for structural, shower base assembly of claim 11, wherein the tile-over shower base pan comprises glass-mat thermoplastic (GMT) allowing for the spanning floor joists for installation of the curbless tiled shower.

* * * * *